US008567778B2

(12) United States Patent
Nakamura

(10) Patent No.: US 8,567,778 B2
(45) Date of Patent: Oct. 29, 2013

(54) SHEET FEEDER, ORIGINAL DOCUMENT TRANSPORT DEVICE, IMAGE FORMING APPARATUS, AND SHEET FEEDING METHOD

(75) Inventor: Shigeaki Nakamura, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 208 days.

(21) Appl. No.: 12/965,231

(22) Filed: Dec. 10, 2010

(65) Prior Publication Data

US 2011/0156347 A1 Jun. 30, 2011

(30) Foreign Application Priority Data

Dec. 28, 2009 (JP) ..... 2009-297513

(51) Int. Cl.
*B65H 7/02* (2006.01)

(52) U.S. Cl.
USPC ..... 271/265.04; 271/117; 271/126; 271/262

(58) Field of Classification Search
USPC ..... 271/117, 126, 262, 265.04
See application file for complete search history.

(56) References Cited

U.S. PATENT DOCUMENTS 6,042,111 A * 3/2000 Rivers et al. ..... 271/270
2008/0012216 A1* 1/2008 Tsukamoto et al. ..... 271/265.01
2008/0277863 A1* 11/2008 Matsutomo et al. ..... 271/262

FOREIGN PATENT DOCUMENTS

CN 101021696 A 8/2007
JP 2008-254896 10/2008

* cited by examiner

*Primary Examiner* — Michael McCullough
*Assistant Examiner* — Howard Sanders
(74) *Attorney, Agent, or Firm* — Smith, Gambrell & Russell, LLP

(57) ABSTRACT

Provided is a sheet feeder, which includes: a sheet placing table; a rotary body which is movable and sends out sheets; a sheet placement detection portion for detecting placement of sheets; an upper limit detection portion for detecting that the rotary body has reached an upper limit position; a transport detection portion for detecting transport of sheets; and a control part which rotates the rotary body so as to perform sheet feeding operation regardless of a detection state of the upper limit detection portion when sheets are set on the sheet placing table, determines that a non-feed jam has occurred when no sheet arriving is detected, and stops rotating the rotary body by determining that the sheet feeder is brought into a sheet feeding restriction state, when sheets are set again on the sheet placing table and the rotary body is detected to be in the upper limit position.

15 Claims, 8 Drawing Sheets

SHEET FEEDER, ORIGINAL DOCUMENT TRANSPORT DEVICE, IMAGE FORMING APPARATUS, AND SHEET FEEDING METHOD

This application is based upon and claims the benefit of priority from the corresponding Japanese Patent Application No. 2009-297513 filed on Dec. 28, 2009, the entire contents of which are incorporated herein by reference.

BACKGROUND OF THE INVENTION

1. Field of the Invention

The present invention relates to a sheet feeder for transporting sheets, an original document transport device which includes the sheet feeder, and an image forming apparatus, such as a copying machine, a multifunction peripheral, or a facsimile machine. The present invention also relates to a sheet feeding method for the sheet feeder.

2. Description of Related Art

In general, an image forming apparatus that handles sheets, such as a copying machine, a multifunction peripheral, or a facsimile machine, is provided with a sheet feeder for receiving sheets and sending out the sheets as necessary. For example, the sheet feeder is disposed inside an original document transport device for automatically and successively feeding original documents (sheets) one by one to a reading position of an image reading part which reads the original document and generates image data. However, when sheets are stacked exceeding a sheet stacking capacity, the sheet feeder may be jammed with sheets, and hence sheet feeding operation cannot be performed appropriately. Further, the sheets may be damaged by being folded or the like. In view of this, some sheet feeders do not perform sheet feeding operation when too many sheets are stacked thereon.

For example, there is known a sheet feeder which includes: a sheet stacking part; a sheet feeding mechanism for feeding sheets one by one from the sheet stacking part; a device casing for supporting the sheet stacking part so as to be movable in a vertical direction; a driving mechanism for moving the sheet stacking part in the vertical direction; sheet stacking detection means for detecting stacking of sheets on the sheet stacking part; sheet position detection means for detecting that an uppermost sheet is positioned in a sheet feedable position, when the sheet stacking part is moved in an upward direction; and control means for determining that a sheet stacking amount is exceeded when the sheet stacking detection means and the sheet position detection means are each in a detection state before the sheet stacking part is moved in the upward direction, in which the control means prohibits operations of the sheet feeding mechanism and the driving mechanism when it is determined that the sheet stacking amount is exceeded. This configuration is intended for avoiding sheet feeding trouble.

For example, an original document transport device, which is a kind of the sheet feeder, feeds original documents as sheets. The original document transport device may include an original document feeding roller which comes into contact with an uppermost sheet of the original documents placed on the sheet placing table. The original document feeding roller is configured to be movable in a vertical direction, for example, so as not to interfere with the placement of original documents when an original document stack (sheet stack) including a large number of sheets are placed. Further, an upper limit detection sensor may be provided for detecting that the original document feeding roller has reached an upper limit position.

Here, there may be a case where, for example, an original document stack to be placed on the sheet placing table slightly exceeds a loadable thickness (maximum thickness capable of being transported without causing a non-feed jam). In such a case, the original document stack may be placed on the sheet placing table, but may be sandwiched between the original document feeding roller and the sheet placing table because the original document feeding roller is capable of moving upward. In this state, the original document feeding roller may fail to rotate, for example, and hence the original documents cannot be sent out appropriately, which leads to a non-feed jam.

In view of the above, as in the known sheet feeder, the feeding of original documents may be stopped without exception, when the upper limit detection sensor (sheet position detection means) detects that the original document feeding roller is in the upper limit position when original documents are set. When such a control is performed, the occurrence of a non-feed jam may certainly be prevented.

However, depending on the configuration and the mounting position of the upper limit sensor, the upper limit sensor may sometimes detect that the original document feeding roller is in the upper limit position even when the original document feeding roller has not reached the upper limit position completely. In other words, an allowance may be made in the detection performed by the upper limit sensor. Accordingly, even when the upper limit sensor detects that the original document feeding roller is in the upper limit position when original documents are set, a non-feed jam does not necessarily occur. That is, even when the upper limit sensor has detected that the original document feeding roller has reached the upper limit position, feeding operation of sheets or original documents may still be performed without causing a non-feed jam even when several more sheets or original documents are additionally placed thereon.

As described above, in a configuration where the sheet feeding operation is stopped without exception when the upper limit sensor has detected that the sheet feeding roller has reached the upper limit position, there arises a problem that the thickness (number of sheets or original documents) of the sheet stack or of the original document stack to be loaded at one time is reduced as compared with the thickness (number of sheets or original documents) of the sheet stack or of the original document stack that may originally be loadable in the device.

SUMMARY OF THE INVENTION

In view of the above-mentioned problems inherent in the related art, the present invention has been made, and therefore, it is an object of the present invention to suppress an occurrence of a non-feed jam which may be caused when a large number of sheets or original documents are set, while preventing the thickness of the sheet stack or the original document stack to be loaded at one time from being reduced as compared with the thickness of the sheet stack or the original document stack that may originally be loadable in the device.

In order to attain the above-mentioned object, a sheet feeder according to an aspect of the present invention includes: a sheet placing table for receiving sheets to be set thereon; a rotary body movable in a vertical direction, which comes into contact with an uppermost sheet of the set sheets and rotates to send out the sheets from the sheet placing table; a sheet placement detection portion for detecting placement of sheets on the sheet placing table; an upper limit detection portion for detecting that the rotary body is in an upper limit position; a transport detection portion for detecting transport of sheets, which is disposed on a downstream side in a sheet transport direction with respect to the sheet placing table; and a control part which rotates the rotary body so as to perform sheet feeding operation regardless of a detection state of the upper limit detection portion when the sheets are set on the sheet placing table, determines that a non-feed jam has occurred when the transport detection portion detects no sheet arriving, and stops rotating the rotary body by determining that the sheet feeder is brought into a sheet feeding restriction state in which sheet feeding restriction should be imposed, when sheets are set again on the sheet placing table and the upper limit detection portion detects that the rotary body is in the upper limit position.

According to the above-mentioned aspect of the present invention, the occurrence of a non-feed jam to be caused when a large number of sheets or original documents are loaded may be suppressed to minimum, while preventing the thickness of the sheet stack or the original document stack to be loaded at one time from being reduced as compared with the thickness of the sheet stack or the original document stack that may originally be loadable in the device.

Further features and advantages of the present invention will become apparent from the description of embodiments given below.

DETAILED DESCRIPTION OF PREFERRED EMBODIMENTS

In the following, embodiments of the present invention are described with reference to FIGS. 1 to 8. Note that, in the embodiments, a multifunction peripheral 200 (corresponding to an image forming apparatus) is described by way of example. The multifunction peripheral 200 has an original document transport device 100 mounted therein. The original document transport device 100 includes a sheet feeder 1 according to the present invention. In other words, the multifunction peripheral 200 includes the sheet feeder 1 according to the present invention. However, elements described in this embodiment, such as a configuration, an arrangement, and the like, merely serve as examples for description, and hence the scope of the present invention is not limited thereto.

(Schematic Configuration of Multifunction Peripheral 200)

Figure 1:
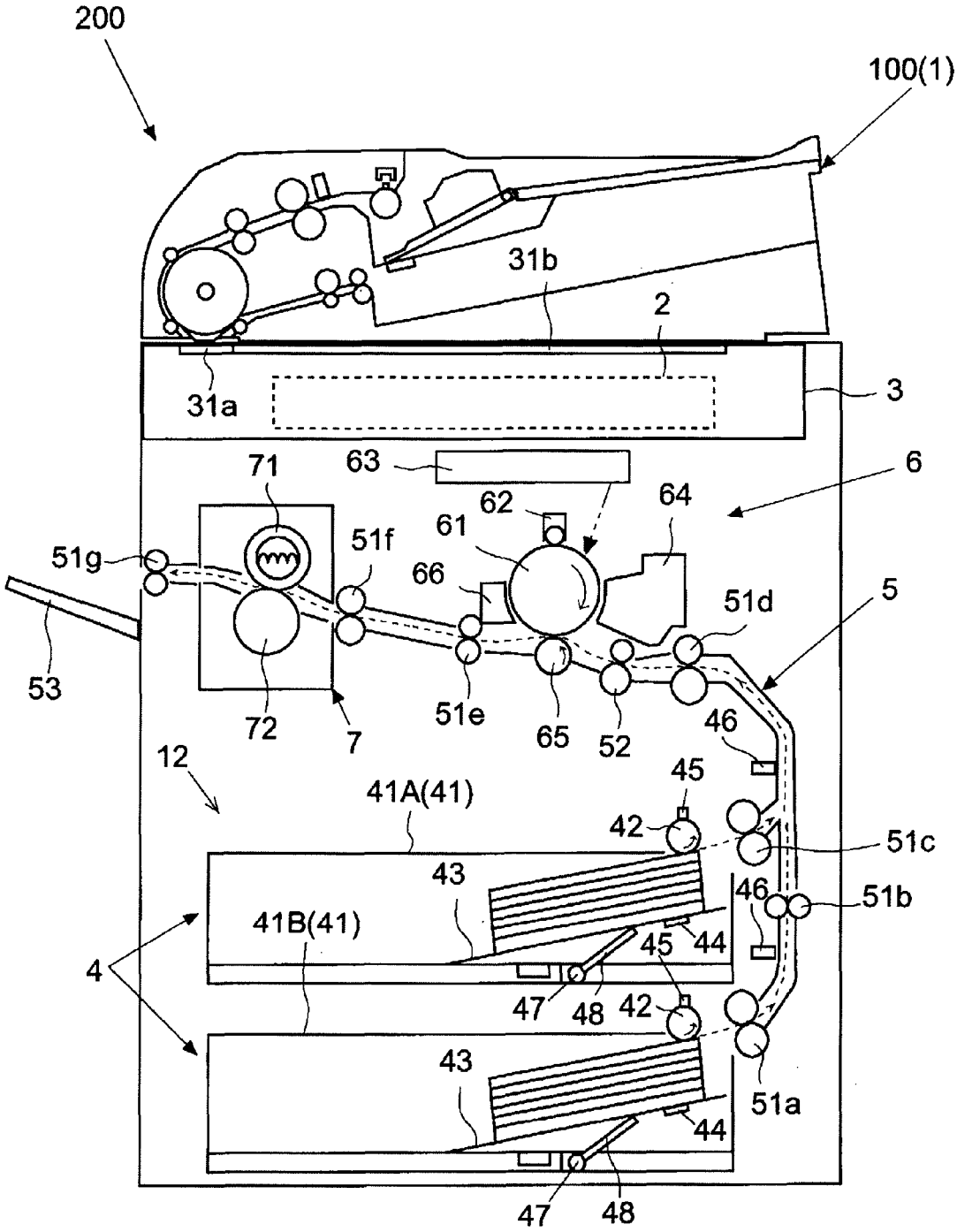
FIG. 1 is a schematic front sectional view of a multifunction peripheral according to an embodiment of the present invention.

First, with reference to FIG. 1, the multifunction peripheral 200 according to an embodiment of the present invention is outlined. FIG. 1 is a schematic front sectional view of the multifunction peripheral 200 according to the embodiment of the present invention.

The multifunction peripheral 200 of this embodiment includes, in the uppermost portion thereof, the original document transport device 100 including the sheet feeder 1 according to the present invention. As illustrated by the broken lines of FIG. 1, an operation panel 2 (corresponding to a notifying part) is provided on the upper side in front, for displaying settings for print, such as a setting of copy operation, and a state of the multifunction peripheral 200. Further, the multifunction peripheral 200 includes, in the main body thereof, an image reading part 3, a sheet feeding part 4, a transport path 5, an image forming part 6, a fixing part 7, and the like.

The image reading part 3 reads an original document and generates image data. On an upper surface of the image reading part 3, a contact glass plate 31 (formed of two kinds, namely, a contact glass plate for flow reading 31*a* and a contact glass plate for fixed reading 31*b*) is disposed. The image reading part 3 includes, inside thereof, an optical system members such as a moving frame (including an exposure lamp, a mirror, and the like) which moves in a horizontal direction (lateral direction of FIG. 1), a lens, an image sensor (for example, a charge coupled device (CCD)), and the like (which are not shown). For example, in the case of reading original documents which are successively transported by the original document transport device 100, the moving frame is fixed below the contact glass plate for flow reading 31*a*, so that reflected light from the original document is guided to the lens and the image sensor. Alternatively, in the case of reading an original document placed on the contact glass plate for fixed reading 31*b*, the moving frame is moved in the horizontal direction, so that reflected light from the original document is guided to the lens and the image sensor.

The image reading part 3 irradiates the original document with light by using those optical system members. Then, the image reading part 3 subjects an output value on each pixel, which is output from the image sensor having received the reflected light from the original document, to analog-to-digital (A/D) conversion, to thereby generate image data. The multifunction peripheral 200 thus reads the image data and performs printing operation based on the image data (copy function).

As the sheet feeding part 4 for receiving and feeding sheets for use in image formation, two cassettes 41 (a cassette 41A above and a cassette 41B below) in total are stacked in a vertical direction. The cassettes 41A and 41B are similar to each other in configuration, and hence members common to the cassettes 41A and 41B are denoted by the same reference numerals. In each cassette 41, a plurality of (for example, about 500 to 1,000) sheets of various types (such as plain paper sheets, copy paper sheets, recycled paper sheets, and the like) in various sizes (such as letter size, A4, A3, B4, and B5) are stacked and received. Each cassette 41 is removably inserted in the multifunction peripheral 200, so that the sheets may be refilled or replaced. Further, each cassette 41 includes a sheet feeding roller 42 which is rotationally driven by a sheet feeding motor M41 (see FIG. 4) for feeding sheets.

The transport path 5 is a passage along which sheets are transported in the multifunction peripheral 200. In the transport path 5, a plurality of transport roller pairs 51 (total of seven pairs of 51*a* to 51*g* from the upstream side are illustrated in FIG. 1), a registration roller pair 52, and the like are disposed. The plurality of transport roller pairs 51 are each rotationally driven when transporting sheets. The registration roller pair 52 holds a sheet to be transported so as to keep the sheet upstream from the image forming part 6, and sends out the sheet in time with the toner image formation. Further, a delivery tray 53 is also provided for receiving sheets to be delivered from a delivery port.

The image forming part 6 forms an image (toner image) on a sheet fed by the sheet feeding part 4, based on image data, to thereby transfer the toner image onto the sheet thus transported. As the image data, image data of the original document acquired by the image reading part 3 or image data transmitted from a computer 300 (see FIG. 4) connected to the multifunction peripheral 200 may be used. The image forming part 6 includes a photosensitive drum 61, which is supported so as to be rotationally driven in a direction of arrow of FIG. 1. Further, a charging device 62, an exposure device 63, a developing device 64, a transfer roller 65, and a cleaning device 66 are disposed on the periphery of the photosensitive drum 61.

Processing of forming and transferring a toner image is described. The charging device 62 charges the photosensitive drum 61, which is rotationally driven at the near-center of the image forming part 6, at a predetermined potential. The exposure device 63 outputs laser light based on image data. The exposure device 63 subjects a surface of the photosensitive drum 61 to scanning and exposure, to thereby form an electrostatic latent image based on image data.

The developing device 64 supplies toner to the electrostatic latent image formed on the photosensitive drum 61, to thereby develop the image. The transfer roller 65 is in pressure-contact with the photosensitive drum 61, to thereby form a nip portion. Then, the registration roller pair 52 inserts a sheet into the nip portion at the right time. When the sheet and the toner image enter the nip portion, the transfer roller 65 is applied with a predetermined voltage, and the toner image on the photosensitive drum 61 is transferred onto the sheet. The cleaning device 66 removes a residue of toner or the like remaining on the photosensitive drum 61 after the image transfer.

The fixing part 7 fixes the transferred toner image onto the sheet. The fixing part 7 according to this embodiment mainly includes a heating roller 71 incorporating a heating element therein and a pressure roller 72. The heating roller 71 and the pressure roller 72 are in pressure-contact with each other, to thereby form a nip portion. When the sheet passes through the nip portion, the toner is fused and heated, so that the toner image is fixed onto the sheet. The sheet having the toner image fixed thereon is delivered to the delivery tray 53.

(Original Document Transport Device 100)

Figure 2:
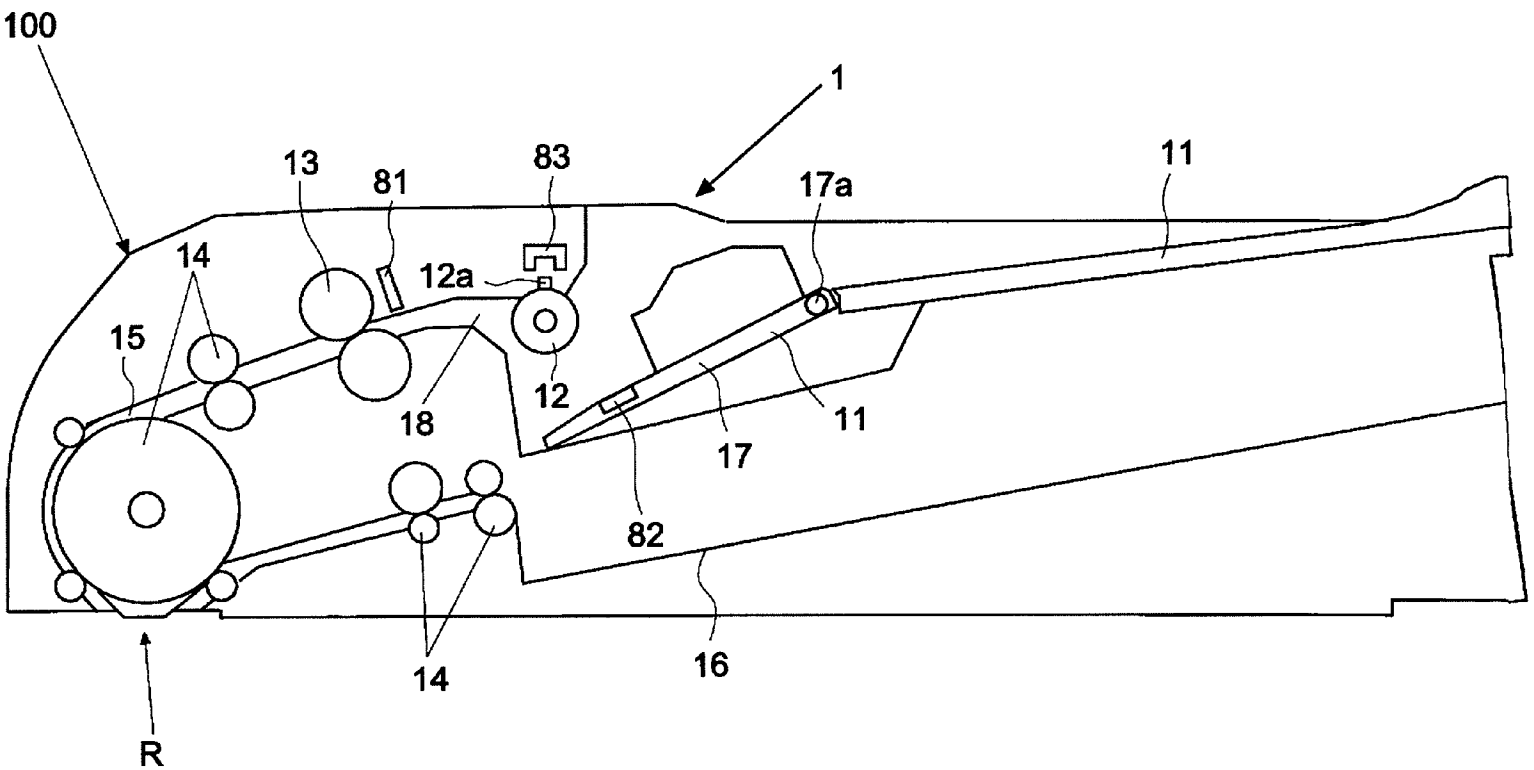
FIG. 2 is a schematic front sectional view illustrating an example of an original document transport device according to the embodiment.

Next, with reference to FIG. 2, a description is given of an example of the original document transport device 100 according to the embodiment of the present invention. FIG. 2 is a schematic front sectional view illustrating an example of the original document transport device 100 according to the embodiment of the present invention.

The original document transport device 100 transports sheets, which are stacked on an original document tray 11 (corresponding to a sheet placing table), one by one, to a reading position R of the image reading part 3. The original document transport device 100 includes an original document transport path 15 which is substantially in a U-shape, and further includes, along the original document transport path 15, the original document tray 11, an original document feeding roller 12 (corresponding to a rotary body), an original document registration roller pair 13, a plurality of original document transport roller pairs 14, and an original document delivery tray 16, which are disposed in the stated order from the upstream side of the original document transport path 15. The original document tray 11 has a plurality of original documents stacked thereon. The original document feeding roller 12 sends out the original documents. The original document registration roller pair 13 starts transporting operation of the original document in time with image reading operation performed by the image reading part 3.

A plurality of original documents to be copied or scanned may be stacked on the original document tray 11. The original document tray 11 is bent in the middle, and a portion on the downstream side in the original document transport direction of the original document tray 11 thus bent in the middle serves as a raising and lowering part 17 which is raised or lowered. Further, a rotary shaft 17*a* is provided at an end portion on the upstream side of the raising and lowering part 17, so as to extend in a direction (vertical direction with respect to the paper plane of FIG. 2) which is perpendicular to the original document transport direction. The rotary shaft 17*a* is rotated by a raising and lowering motor M11 (see FIG. 4) that rotates clockwise and counterclockwise, which is described later. The operation of the original document tray 11 to be performed when the original documents are stacked thereon is described later in detail.

The original document feeding roller 12, which comes into contact with an uppermost original document, is disposed at an upstream end of the original document transport path 15. Note that, FIG. 2 illustrates only one original document feeding roller 12. However, the original document feeding roller 12 may include a plurality of rollers. An original document passes through a sheet feeding port 18 on the downstream side of the original document feeding roller 12 in the original document transport direction, to enter the original document transport path 15. The original document registration roller pair 13 is disposed on the downstream side with respect to the sheet feeding port 18 in the original document transport direction.

An original document transport detection sensor 81 (corresponding to a transport detection portion) for detecting the arrival and passage of an original document is disposed between the original document registration roller pair 13 and the sheet feeding port 18. The original document transport detection sensor 81 is, for example, a transmissive optical sensor, and produces an output that varies depending on the presence or absence of an original document in a detection range. Note that, the original document transport detection sensor 81 is not limited to the optical sensor, and may be any sensor (for example, mechanical switch) capable of producing an output that varies depending on the arrival and passage of an original document. When the original documents stacked on the original document tray 11 are too many, the original document feeding roller 12 fails to rotate and cannot feed original documents. In such a case, the arrival of an original document cannot be detected even after a lapse of a predetermined amount of time from the start of the operation of rotating the original document feeding roller 12, which may be determined as an occurrence of a non-feed jam.

The plurality of original document transport roller pairs 14 are disposed along the original document transport path 15 from the original document registration roller pair 13. The plurality of original document transport roller pairs 14 transport an original document to the reading position R (position above the contact glass plate for flow reading 31*a*). The original document is read by the image reading part 3 at the reading position R. After that, the original document is transported through the plurality of original document transport roller pairs 14, and delivered to the original document delivery tray 16 in the end. Note that, the original document transport device 100 may be held up through a pivot point (not shown) provided on the depth side on the paper plane, so that an original document such as a book may be placed on the contact glass plate for fixed reading 31*b* on the upper surface of the image reading part 3.

(Operation of Original Document Transport Device 100)

Figure 3A:
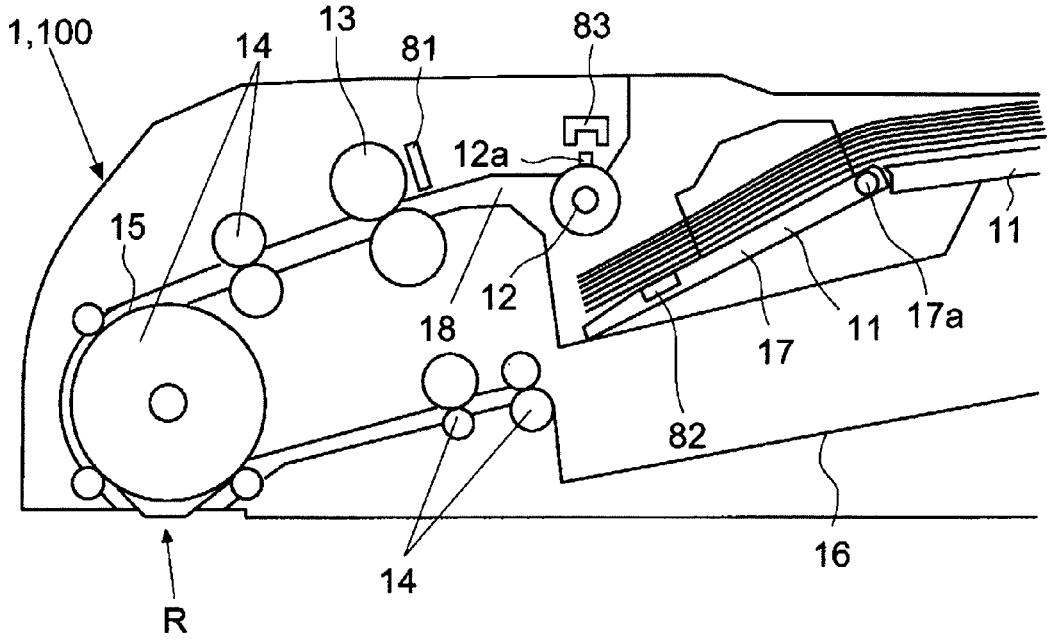
FIG. 3A is an explanatory diagram illustrating an exemplary state of the original document transport device according to the embodiment, in which original documents have just been placed.
Figure 3B:
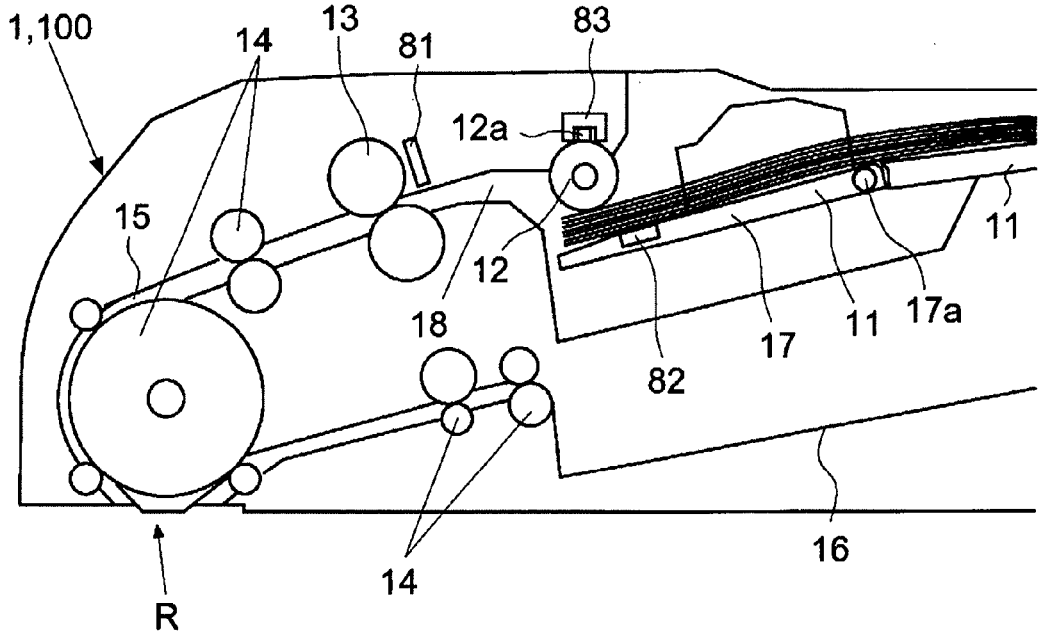
FIG. 3B is an explanatory diagram illustrating an example of a raised state of a raising and lowering part of an original document tray.

Next, with reference to FIGS. 3A and 3B, a description is given of an example of an operation to be performed when an original document is placed in the original document transport device 100 according to the embodiment of the present invention. FIG. 3A is an explanatory diagram illustrating an exemplary state of the original document transport device 100 according to the embodiment of the present invention, in which original documents have just been placed, and FIG. 3B is an explanatory diagram illustrating an example of a raised state of the raising and lowering part 17 of the original document tray 11.

As illustrated in FIG. 3A, when no original document is placed on the original document tray 11 or when the reading of original document is yet to be started, the raising and lowering part 17 of the original document tray 11 is positioned at the lowest point. In other words, the raising and lowering part 17 of the original document tray 11 is in a reference position (initial position) when lowered to a lower limit. The raising and lowering part 17 of the original document tray 11 is lowered, so that more original documents (for example, about 200 sheets to 300 sheets of original documents of plain paper) may be placed on the original document tray 11.

Then, an original document placement sensor 82 (corresponding to sheet placement detection portion) provided in an upper surface of the raising and lowering part 17 detects that original documents are placed on the original document tray 11. Further, various settings, such as a setting of copy operation, are made through the operation panel 2 (see FIG. 5, to be described later in detail), and a start key 24 of the operation panel 2 is pressed to instruct the start of copy operation. In response, the raising and lowering motor M11 (see FIG. 4) is driven and the rotary shaft 17*a* is rotated, so that the raising and lowering part 17 starts rising. Note that, the original document placement sensor 82 may employ, for example, a transmissive optical sensor or a reflective optical sensor. However, the original document placement sensor 82 may be any sensor (for example, mechanical switch which operates when an original document is placed) capable of detecting that an original document is placed on the original document tray 11. Note that, without waiting for the start key 24 to be pressed, the raising and lowering part 17 may start rising after a lapse of a predetermined amount of time (for example, several seconds) from the placement of the original documents.

Here, the original document feeding roller 12 feeds the original documents one by one to the original document transport path 15. The original document feeding roller 12 is movable in a vertical direction. For example, the original document feeding roller 12 has a rotary shaft guided by a member for guiding the movement in a vertical direction. The original document feeding roller 12 hangs down (see FIG. 3A) when no original document is placed on the original document tray 11 (when the raising and lowering part 17 is lowered to the lower limit position). When the raising and lowering part 17 is raised, the uppermost original document and the original document feeding roller 12 come into contact with each other. Further, the raising and lowering part 17 holds up the original document feeding roller 12 with the original documents placed thereon.

A protrusion 12*a* is formed above the original document feeding roller 12. When the original document feeding roller 12 is held up to an upper limit position, the protrusion 12*a* is fit into a hollow portion in the upper limit detection sensor 83 (corresponding to an upper limit detection portion). The upper limit detection sensor 83 detects that the original document feeding roller 12 and the original document are brought into contact with each other and the raising and lowering part 17 is raised to the upper limit.

For example, the upper limit detection sensor 83 may employ a transmissive optical sensor which includes a light emitting part and a light receiving part in an inner surface of the hollow portion. The protrusion 12*a* obstructs the optical path from the light emitting part to the light receiving part of the optical sensor, and hence the output from the light receiving part is changed. Based on the change in output, it is detected that the raising and lowering part 17 and the original document feeding roller 12 are raised to the upper limit position (arrive at the upper limit position). However, the upper limit detection sensor 83 is not limited to the transmissive optical sensor, and may employ any sensor (for example, mechanical switch) capable of detecting that the raising and lowering part 17 is raised to the upper limit. When it is detected by the upper limit detection sensor 83 that the original document feeding roller 12 and the raising and lowering part 17 have been raised to the upper limit, the original document transport device 100 is ready for transporting original documents (see FIG. 3B).

(Hardware Configuration of Multifunction Peripheral 200)

Figure 4:
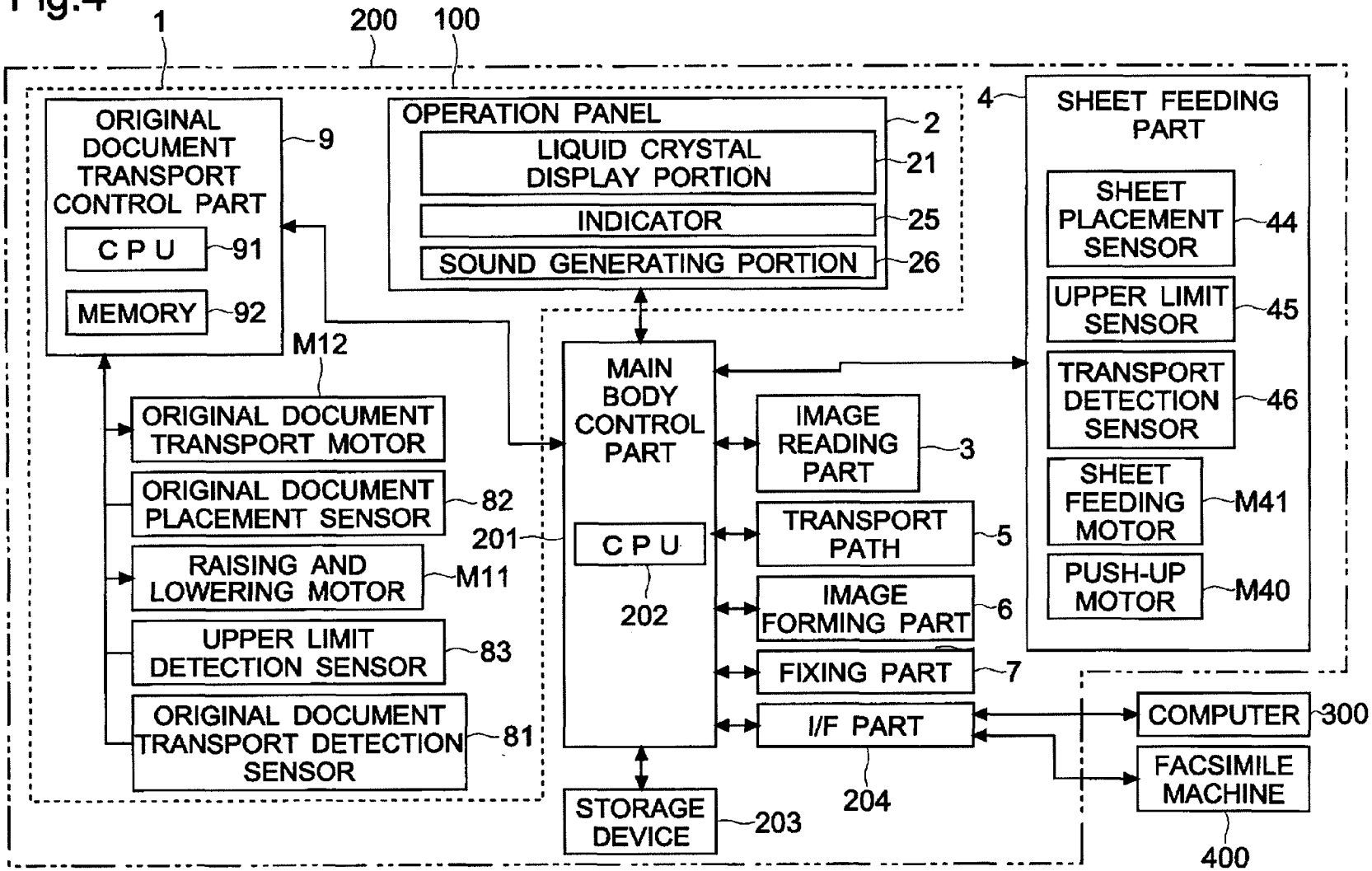
FIG. 4 is a block diagram illustrating an example of a hardware configuration of the multifunction peripheral according to the embodiment.

Next, with reference to FIG. 4, a description is given of an example of a hardware configuration of the multifunction peripheral 200 according to the embodiment of the present invention. FIG. 4 is a block diagram illustrating an example of the hardware configuration of the multifunction peripheral 200 according to the embodiment of the present invention.

First, a main body control part 201 is provided inside the multifunction peripheral 200 main body, as a part for controlling an operation of the multifunction peripheral 200. Note that, the main body control part 201 may be divided according to function and provided as a plurality of parts, such as a main control part for performing overall control and image processing and an engine control part for controlling image formation and printing through ON/OFF control on a motor or the like for rotating various rotary bodies. In the description to be given herein, a configuration in which the above-mentioned plurality of control parts are integrated into one control part is illustrated.

The main body control part 201 includes at least one central processing unit (CPU) 202. The main body control part 201 is connected to a storage device 203. The storage device 203 is capable of storing image data as well as a program and data for controlling the multifunction peripheral 200. For example, the storage device 203 is a combination of a volatile storage device such as a random access memory (RAM) and a non-volatile storage device such as a read-only memory (ROM), a hard disk drive (HDD), or a flash ROM. The CPU 202 performs arithmetic operations, and transmits and receives control signals, based on programs and data stored in the storage device 203, to thereby control the multifunction peripheral 200.

The main body control part 201 is connected to the image reading part 3, the sheet feeding part 4, the transport path 5, the image forming part 6, and the fixing part 7 in the multifunction peripheral 200 main body, to thereby perform control on each part. Further, the main body control part 201 is communicably connected to the operation panel 2, so that an instruction input by a user through the operation panel 2 is conveyed to the main body control part 201. The main body control part 201 receives and recognizes the instruction input by the user.

Further, the main body control part 201 is connected to an interface (I/F) part 204 serving as an interface for performing communications to a computer 300 (for example, personal computer) or a facsimile machine 400 on the other end via a network, a cable, or a communication network. With this configuration, the multifunction peripheral 200 is capable of performing printing (printer function) based on image data or the like received from the computer 300, storing image data read by the image reading part 3 in the storage device 203 and then transmitting the image data to the computer 300 (scanner function), and exchanging image data with the external facsimile machine 400 (facsimile function).

Further, the main body control part 201 is communicably connected to an original document transport control part 9 (corresponding to a control part) which is provided inside the original document transport device 100 and controls the original document transport device 100. When performing a copy operation or the like, the main body control part 201 provides instructions to the original document transport control part 9, and the original document transport control part 9 actually controls the processing and operation of the original document transport device 100 following the instructions.

A CPU 91 is provided to the original document transport control part 9, as a central processing unit of the original document transport device 100. A memory 92 (corresponding to a memory portion) stores programs and data for controlling the original document transport device 100. Further, the memory 92 stores, at the occurrence of a non-feed jam, the transport state of the original document (which is described later in detail). Based on the programs and data, the original document transport control part 9 performs ON/OFF control on an original document transport motor M12 for rotating the original document transport roller pairs 14 and the original document feeding roller 12 and the raising and lowering motor M11 for raising and lowering the raising and lowering part 17, and controls the rotation direction of the raising and lowering motor M11 to be in a clockwise or counterclockwise direction.

The original document transport control part 9 receives a voltage output from the original document placement sensor 82. Then, the original document transport control part 9 detects and recognizes that an original document is placed on the original document tray 11. Further, the original document transport control part 9 receives a voltage output from the upper limit detection sensor 83. Then, the original document transport control part 9 detects and recognizes that the raising and lowering part 17 of the original document tray 11 has been raised to the upper limit. Further, the original document transport control part 9 receives a voltage output from the original document transport detection sensor 81. Then, when the arrival of a sheet is not detected even after a lapse of a predetermined amount of time from the start of rotation of the original document feeding roller 12, the original document transport control part 9 detects and determines that a non-feed jam has occurred in which no sheet is fed.

(Non-Feed Jam)

Figure 5:
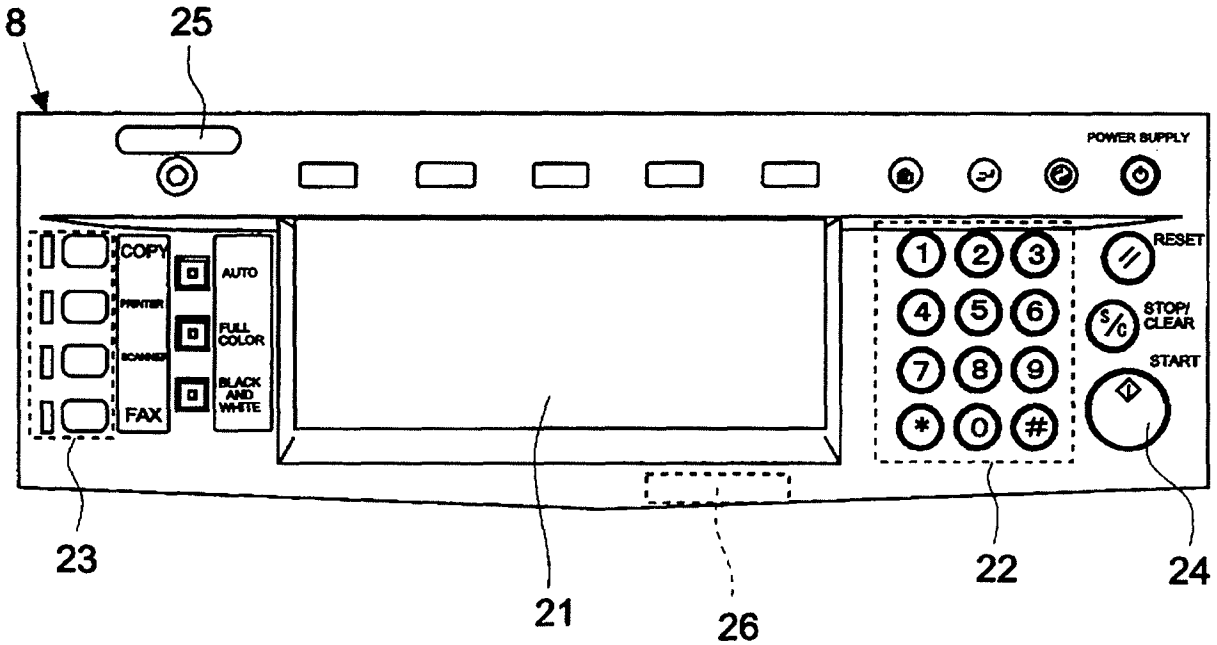
FIG. 5 is a plan view illustrating an example of an operation panel according to the embodiment.

Next, with reference to FIGS. 4 and 5, the non-feed jam is described. FIG. 5 is a plan view illustrating an example of the operation panel 2 according to the embodiment of the present invention.

The original document transport device 100 according to this embodiment includes the sheet feeder 1 for performing sheet feeding operation by sending out original documents stacked thereon to the original document transport path 15. When the original documents stacked thereon are too many, there occurs a phenomenon in which, for example, the original document stack is sandwiched by the original document tray 11 and the original document feeding roller 12, and hence the original document feeding roller 12 fails to rotate, or even when the original document feeding roller 12 is allowed to rotate, the sheets are not transported properly. As a result, a non-feed jam may occur, in which original documents cannot be sent out to the sheet feeding port 18 appropriately as described above. In such a case, when the operation of rotating the original document feeding roller 12 is kept being performed, the original document transport motor M12 or a gear for conveying a drive force from the original document transport motor M12 to the original document feeding roller 12 may be damaged, or the original documents may be wrinkled or torn to be damaged.

In view of the above, when the original document transport detection sensor 81 does not detect the arrival of an original document within a predetermined amount of time even when the operation of rotating the original document feeding roller 12 is performed, the original document transport control part 9 according to this embodiment determines that a non-feed jam has occurred. When a non-feed jam occurs, the original document transport control part 9 stops the operation of rotating the original document feeding roller 12. Further, the original document transport control part 9 notifies the main body control part 201 that a non-feed jam has occurred, and the main body control part 201 causes a liquid crystal display portion 21 of the operation panel 2 to perform display for notifying the occurrence of a non-feed jam. Accordingly, as illustrated in FIG. 4, the sheet feeder 1, the original document transport device 100, and the multifunction peripheral 200 according to the present invention include the operation panel 2. In other words, the operation panel 2 serves as the notifying part for notifying the states of the sheet feeder 1, the original document transport device 100, and the multifunction peripheral 200.

The operation panel 2 is disposed, as illustrated by the broken lines of FIG. 1, on the upper side on the front surface of the multifunction peripheral 200. Further, as illustrated in FIG. 5, the operation panel 2 includes the liquid crystal display portion 21 with a touch panel, and also includes a plurality of keys such as a numeric keypad portion 22, a function selection key group 23, and a start key 24.

The liquid crystal display portion 21 performs display on printing. The liquid crystal display portion 21 displays the states of the multifunction peripheral 200 and the original document transport device 100, for example, a printing status and an occurrence of a non-feed jam in the multifunction peripheral 200. Further, the liquid crystal display portion 21 displays, for example, keys and buttons for setting functions in the multifunction peripheral 200 regarding the size of sheet to be used in printing, scaling, or the density in printing. Then, the coordinates of a pressed position on the touch panel are detected, to thereby detect, by the operation panel 2, that the user has pressed the keys and buttons displayed on the liquid crystal display portion 21. This configuration allows the user to make settings on each function of the multifunction peripheral 200.

The function selection key group 23 includes a plurality of keys for selecting functions, such as a copy function, a scanning function, and a facsimile function, to be used in the multifunction peripheral 200. The user presses a key corresponding to a function to be used or set.

The numeric keypad portion 22 includes a combination of keys indicating numbers of 0 to 9 and keys of symbols such as an asterisk (*) key and a pound (#) key. The numeric keypad portion 22 is used for inputting numbers, for example, for inputting the number of copies to be printed when using a copy function, or for inputting a facsimile number when performing facsimile transmission.

The start key 24 is pressed when instructing a start of operation after the settings have been made through, for example, the liquid crystal display portion 21 and the numeric keypad portion 22. For example, when making a copy, the user places an original document on the original document transport device 100, inputs the number of copies to be printed through the numeric keypad portion 22 or the like, and makes various settings by selecting the sheet size to be used in printing. After that, the user presses the start key 24, so that the multifunction peripheral 200 starts reading and printing the original document according to the settings thus made.

In order to notify an occurrence of an error such as a non-feed jam, an indicator 25 (for example, a light emitting device (LED)), a sound generating portion 26 (for example, including a speaker which may be provided to a rear surface of the operation panel 2), and the like, may be provided. The indicator 25 lights up or flashes to notify an occurrence of an error. The sound generating portion 26 generates a sound to notify an occurrence of an error.

(Sheet Feeding Restriction Control on Occurrence of Non-Feed Jam)

Figure 6:
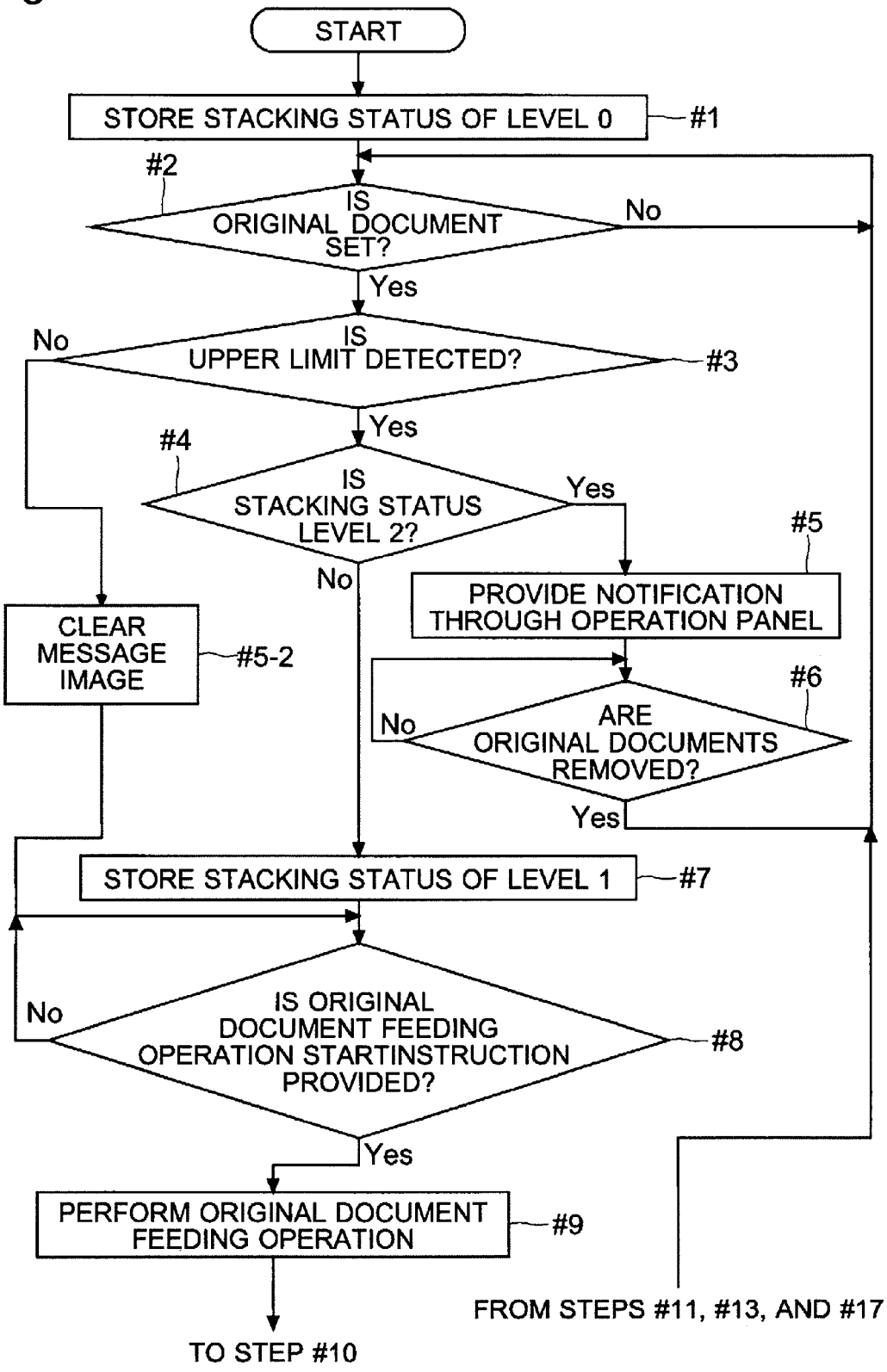
FIG. 6 is a flow chart illustrating an example of sheet feeding restriction control to be performed in the original document transport device according to the embodiment.
Figure 7:
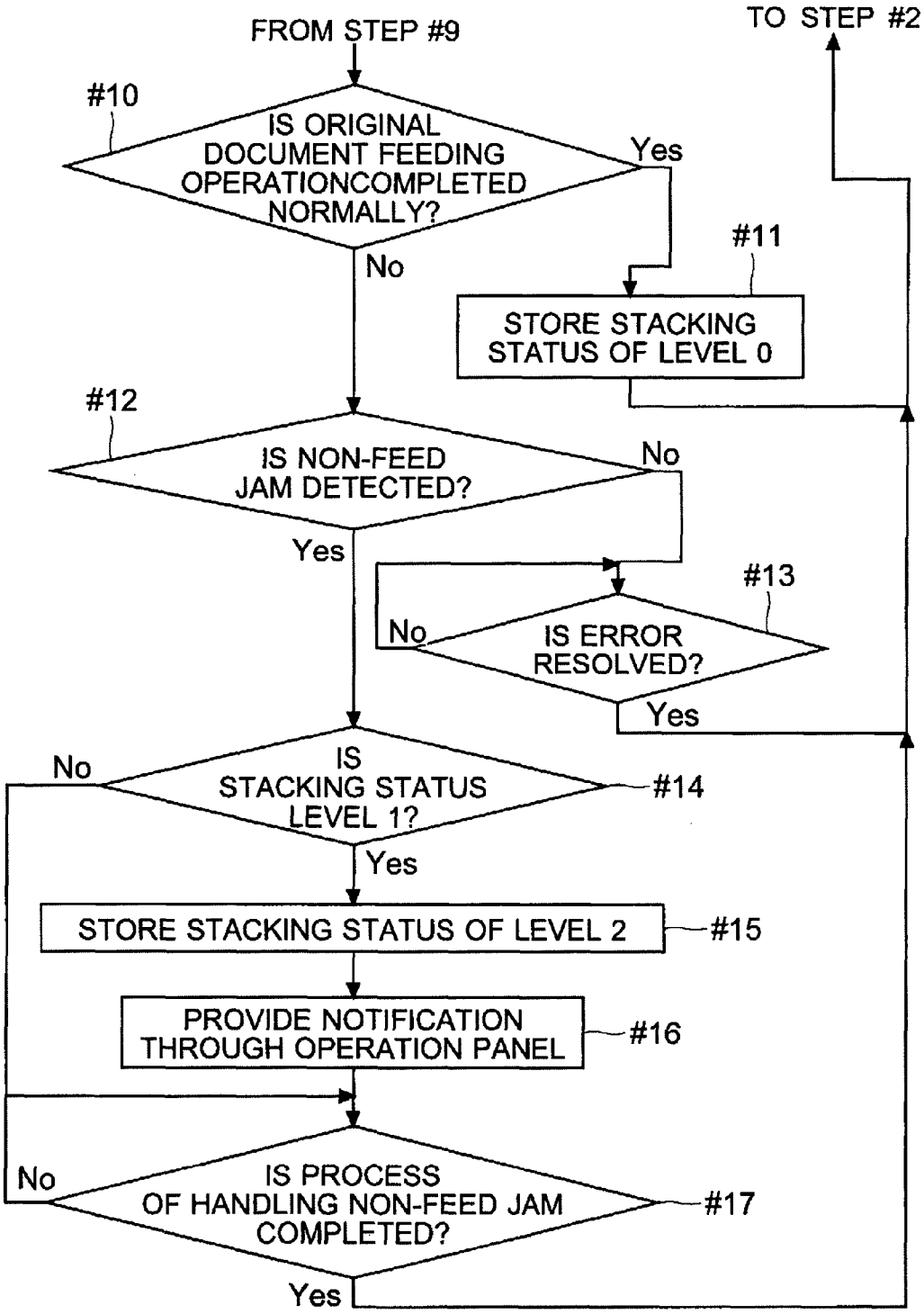
FIG. 7 is a flow chart illustrating the example of the sheet feeding restriction control to be performed in the original document transport device according to the embodiment.
Figure 8:
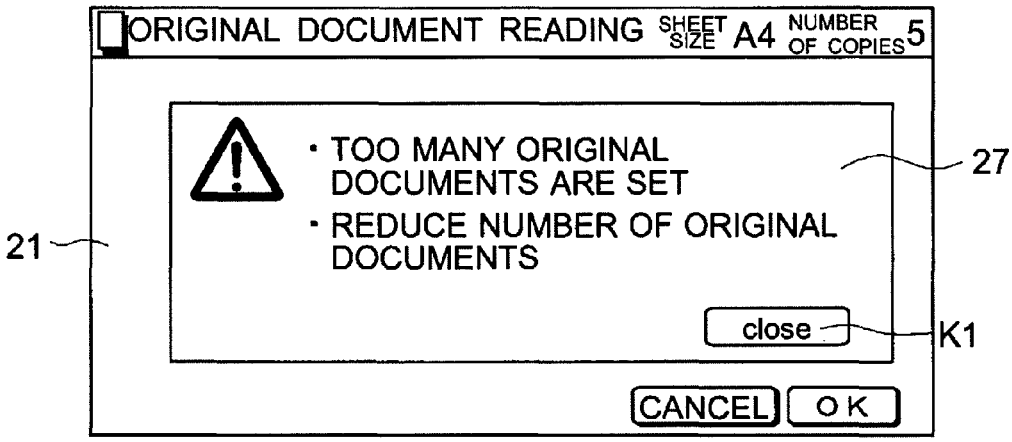
FIG. 8 illustrates an example of a display to be displayed on a liquid crystal display portion when a sheet feeding restriction is imposed in the original document transport device according to the embodiment.

Next, with reference to FIGS. 6 to 8, a description is given of an example of sheet feeding restriction control to be performed in the original document transport device 100 according to the embodiment of the present invention. FIGS. 6 and 7 are flow charts illustrating the example of the sheet feeding restriction control to be performed in the original document transport device 100 according to the embodiment of the present invention. The flow charts of FIGS. 6 and 7 illustrate a series of processing, which is divided into two charts due to limitations of space. FIG. 8 illustrates an example of a display to be displayed on the liquid crystal display portion 21 when the sheet feeding restriction is imposed in the original document transport device 100 according to the embodiment of the present invention.

Here, according to the sheet feeding restriction control of this embodiment, the stacking states of original documents are categorized into different cases and stored in the memory 92. The original document transport control part 9 performs control according the stacking states of original documents stored in the memory 92. For example, the stacking states of original documents are categorized into different levels as described below, and the stacking states of original documents are each stored like a flag in the memory 92.

Note that, in the stacking states of original documents described below, a state in which the upper limit detection sensor 83 is turned OFF refers to a "state in which the upper limit detection sensor 83 detects that the original document feeding roller 12 is not in the upper limit position before the raising and lowering part 17 is raised." On the other hand, a state in which the upper limit detection sensor 83 is turned ON refers to a "state in which the upper limit detection sensor 83 detects that the original document feeding roller 12 is in the upper limit position before the raising and lowering part 17 is raised."

Level 0: "a state in which the upper limit detection sensor 83 is turned OFF when original documents are set on the original document tray 11"

Level 1: "a state in which the upper limit detection sensor 83 is turned ON but a non-feed jam has not occurred when original documents are set on the original document tray 11"

Level 2: "a state in which the upper limit detection sensor 83 is turned ON and a non-feed jam has occurred when original documents are set on the original document tray 11" (corresponding to a sheet feeding restriction state in the scope of claims)

First, the flow chart of FIG. 6 is started at turn-ON of a main power supply of the multifunction peripheral 200 or after the multifunction peripheral 200 has recovered from a power-saving mode such as a sleep mode (or when the original document transport control part 9 is activated). First, the original document transport control part 9 stores, as an initial (first) stacking state (staking status) of original documents, data indicating "Level 0" in the memory 92 (Step #1). Then, the original document transport control part 9 checks the output from the original document placement sensor 82 to see whether original documents are set (Step #2). The original document transport control part 9 periodically checks whether original documents are set until original documents are set ('No' in Step #2 to Step #2).

Meanwhile, once original documents are set ('Yes' in Step #2), the original document transport control part 9 checks the output from the upper limit detection sensor 83 to see whether the upper limit detection sensor 83 has detected that the original document feeding roller 12 is in the upper limit position (Step #3). When the upper limit detection sensor 83 has not detected that the original document feeding roller 12 is in the upper limit position ('No' in Step #3), the stacking status is not changed. Note that, the raising and lowering part 17 may be raised after performing the process of checking the output in Step #3.

After that, the processing proceeds to Step #5-2 and Step #8 (which are described later in detail). On the other hand, when the upper limit detection sensor 83 has detected that the original document feeding roller 12 is in the upper limit position ('Yes' in Step #3), the original document transport control part 9 checks the data in the memory 92 to see whether the stacking status is Level 2 (Step #4). Note that, the stacking status may be changed to Level 2 when the processing is looped back to Step #4 from any of the subsequent processes.

When the stacking status is Level 2 ('Yes' in Step #4), a non-feed jam is highly likely to occur, and hence the sheet feeding is restricted so that original documents are not fed. That is, the control part (original document transport control part 9) does not cause the rotary body (original document feeding roller 12) to rotate, under a state in which the rotary body (original document feeding roller 12) is detected to be in the upper limit position by the upper limit detection portion (upper limit detection sensor 83) and the stacking status is stored as the sheet feeding restriction state (Level 2) in the memory portion (memory 92), when sheets are set on the sheet placing table (original document tray 11).

Specifically, when the stacking status is Level 2, the original document transport control part 9 provides notification through the operation panel 2 as illustrated in FIG. 8 (Step #5). The instruction to the operation panel 2 may be directly provided by the original document transport control part 9 to the operation panel 2, or may be conveyed via the main body control part 201.

The operation panel 2 has, for example, a message image 27 displayed on the liquid crystal display portion 21 of the operation panel 2, as illustrated in FIG. 8, to the effect that original documents (sheets) placed on the original document tray 11 are too many or the original documents (sheets) should be reduced. The message image 27 includes a close key K1. The user presses the close key K1 to clear the displayed message image 27. Note that, in addition to the liquid crystal display portion 21, the indicator 25 may be light up or the sound generating portion 26 may be used, to thereby notify that the original documents are too many.

After the notification is provided through the operation panel 2, the original document transport control part 9 checks the output from the original document placement sensor 82, to see repeatedly whether the original documents are removed from the original document tray 11 (Step #6 and 'No' in Step #6). When the original documents are removed from the original document tray 11 ('Yes' in Step #6), the processing returns, for example, to Step #2. At this time, when the raising and lowering part 17 is in the raised state, the raising and lowering part 17 is lowered to the reference position.

On the other hand, when it is confirmed in Step #4 that the stacking status is not Level 2 ('No' in Step #4), the original document transport control part 9 stores, as the stacking status, data indicating "Level 1" in the memory 92 (Step #7).

After that, the original document transport control part 9 repeatedly checks whether an original document feeding operation start instruction is provided by the main body control part 201, which is given when the start key 24 is pressed (Step #8 and 'No' in Step #8). When using, for example, a copy function, a scanning function, or a facsimile function, the user may press the start key 24 in the operation panel 2 to instruct the multifunction peripheral 200 to start operation. The pressing of the start key 24 is conveyed from the operation panel 2 to the main body control part 201. In response to the pressing of the start key 24 thus conveyed, the main body control part 201 provides the original document feeding operation start instruction to the original document transport control part 9. Note that, the operation panel 2 may directly convey the pressing of the start key 24, to the original document transport control part 9.

When the original document feeding operation start instruction is provided ('Yes' in Step #8), the original document transport control part 9 raises the raising and lowering part 17, drives the original document transport motor M12, and rotates the original document feeding roller 12, to thereby perform original document feeding operation (Step #9). As described above, in the case where the stacking status is not stored as the sheet feeding restriction state (Level 2) in the memory portion (memory 92), the control part (original document transport control part 9) causes the rotary body (original document feeding roller 12) to rotate when sheets are placed on the sheet placing table (original document tray 11), regardless of the detection state of the upper limit detection portion (upper limit detection sensor 83).

The original document transport control part 9 raises the raising and lowering part 17 as necessary when transporting original documents. That is, the sheet feeder 1, the original document transport device 100, the image forming apparatus (the multifunction peripheral 200) of this embodiment include the raising and lowering part 17 for raising and lowering the sheet placing table (original document tray 11). The raising and lowering part 17 lowers the sheet placing table (the original document tray 11 and the raising and lowering part 17) to the lower limit position when no sheet is placed on the sheet placing table. When sheets are placed on the sheet placing table (the original document tray 11 and the raising and lowering part 17), the raising and lowering part 17 raises the sheet placing table (the original document tray 11 and the raising and lowering part 17) until the upper limit detection portion (upper limit detection sensor 83) detects that the rotary body (original document feeding roller 12) has reached the upper limit position. Further, when transporting original documents, the raising and lowering part 17 gradually raises the sheet placing table (the original document tray 11 and the raising and lowering part 17) so that the rotary body (original document feeding roller 12) always comes into contact with the uppermost original document.

Then, the original document transport control part 9 checks whether the feeding of original documents is normally completed without an occurrence of an error (Step #10). When the feeding of original documents is normally completed without an occurrence of an error ('Yes' in Step #10), the original document transport control part 9 stores, as the stacking status, data indicating "Level 0" in the memory 92 (Step #11). That is, the sheet feeder 1, the original document transport device 100, and the image forming apparatus (multifunction peripheral 200) of this embodiment include the memory portion (memory 92) for storing data indicating that the stacking status is the sheet feeding restriction state (Level 2). When sheets are set on the sheet placing table (original document tray 11), the control part (original document transport control part 9) rotates the rotary body as long as the rotary body (original document feeding roller 12) is not detected to be in the upper limit position by the upper limit detection portion (upper limit detection sensor 83), even when the memory portion stores the data indicating that the stacking status is the sheet feeding restriction state. When the sheet feeding operation is completed without an occurrence of non-feed jam, the control part deletes the data indicating the sheet feeding restriction state stored in the memory portion. After that, the processing returns to Step #2, in which the original document transport control part 9 checks whether original documents (sheets) are placed again.

On the other hand, when the sheet feeding operation is not completed normally ('No' in Step #10), the original document transport control part 9 checks whether the non-feed jam is detected (Step #12). When the feeding of original documents is stopped due to factors such as a jam on the original document transport path 15 or a jam on the transport path 5 on the main body side, other than the non-feed jam ('No' in Step #12), for example, the original document transport control part 9 repeatedly checks whether an original document remaining in the original document transport path 15 is removed, or whether it is notified by main body control part 201 that the error is resolved, to thereby confirm that the error is resolved (Step #13 and 'No' in Step #13). When the error is resolved ('Yes' in Step #13), the processing returns to Step #2.

Alternatively, when a non-feed jam is detected in Step #12 ('Yes' in Step #12), the original document transport control part 9 checks whether the stacking status stored in the memory 92 is Level 1 (Step #14). That is, the original document transport control part 9 checks whether sheet feeding operation has been performed in a state in which the original document feeding roller 12 is detected to be in the upper limit position by the upper limit detection sensor 83 (Step #14). When the stacking status is Level 1 ('Yes' in Step #14), the original document transport control part 9 stores, as the stacking status, data indicating "Level 2" in the memory 92 (Step #15). In this manner, after sheet feeding operation has been performed and a non-feed jam has once occurred, when the original documents are newly set and the original document feeding roller 12 is detected to be in the upper limit position by the upper limit detection sensor 83, the original document transport control part 9 does not perform sheet feeding operation, to thereby impose sheet feeding restriction (Step #5 and Step #6).

That is, the sheet feeder 1, the original document transport device 100, and the image forming apparatus (multifunction peripheral 200) of this embodiment include: the sheet placing table (the original document tray 11 and the raising and lowering part 17) for receiving sheets to be stacked thereon; the rotary body (original document feeding roller 12) movable in a vertical direction, which comes into contact with the uppermost sheet of the stacked sheets and rotates to send out the sheets from the sheet placing table; the sheet placement detection portion (original document placement sensor 82) for detecting that sheets are placed on the sheet placing table; the upper limit detection portion (upper limit detection sensor 83) for detecting that the rotary body is in the upper limit position; the transport detection portion (original document transport detection sensor 81) for detecting the transport of sheets, which is disposed downstream in the sheet transport direction with respect to the sheet placing table; and the control part (original document transport control part 9) which rotates the rotary body so as to perform sheet feeding operation regardless of a detection state of the upper limit detection portion when the sheets are set on the sheet placing table, determines that a non-feed jam has occurred when the transport detection portion detects no sheet arriving (even when the sheet feeding operation is performed), and does not rotate the rotary body by determining that the sheet feeder is brought into a sheet feeding restriction state (Level 2) in which sheet feeding restriction should be imposed, when sheets are set again (for the first time after the occurrence of the non-feed jam) on the sheet placing table and the upper limit detection portion detects that the rotary body is in the upper limit position. More specifically, when the sheets that have caused the non-feed jam are removed from the sheet placing table and sheets are newly set on the sheet placing table, when the upper limit detection portion detects that the rotary body is in the upper limit position before the raising and lowering part 17 raises the sheet placing table, the control part determines that the sheet feeder is brought into the sheet feeding restriction state.

After that, similarly to Step #5, the original document transport control part 9 provides notification through the operation panel 2 (Step #16). That is, the sheet feeder 1, the original document transport device 100, and the image forming apparatus (multifunction peripheral 200) include the notifying part (operation panel 2) for notifying the states of the sheet feeder 1, the original document transport device 100, and the image forming apparatus. The notifying part notifies that too many sheets are set, when the sheet feeder is brought into the sheet feeding restriction state (in Step #16), and when sheets are placed on the sheet placing table (original document tray 11) and the rotary body (original document feeding roller 12) is detected to be in the upper limit position by the upper limit detection portion (upper limit detection sensor 83) under a state in which the memory portion (memory 92) stores the sheet feeding restriction state (in Step #5).

Note that, the message image 27 displayed on the operation panel 2 in each of Steps #5 and #16 is automatically cleared (Step #5-2), when, for example, the processing returns to Step #2 to set original documents (sheets) again (Step #2), and the upper limit is not detected ('No' in Step #3). Alternatively, when original documents are left unremoved without the close key K1 being pressed after the message image 27 is displayed, or when original documents are removed but the close key K1 is not pressed, the message image 27 may be automatically cleared after a lapse of a predetermined amount of time from the start of the display of the message image 27 or from the removal of the original documents. For example, the predetermined amount of time may be arbitrarily set (for example, to several minutes). Alternatively, the predetermined amount of time may be set through the operation panel 2. As described above, the message image 27 is cleared automatically, and hence another user different from the user who has caused a non-feed jam can use the multifunction peripheral 200 without being disturbed by visually identifying the irrelevant message image 27.

The original document transport control part 9 repeatedly checks whether the process of handling the non-feed jam is completed until it is confirmed that the process is completed (Step #17 and 'No' in Step #17). For example, the original document transport control part 9 checks the output from the upper limit detection sensor 83 and the output from the original document placement sensor 82, and determines that the process of handling the non-feed jam is completed when the original document feeding roller 12 is not detected to be in the upper limit position by the upper limit detection sensor 83 and when the original documents are removed from the original document tray 11. When the original document transport control part 9 confirms the completion of the process of handling the non-feed jam ('Yes' in Step #17), the processing returns to Step #2.

Note that, a non-feed jam may occur at Level 0, for example, in a case of feeding stapled original documents, or when original documents are placed as being displaced from one another on the original document tray 11. Accordingly, when in the case of 'No' in Step #14 (when a non-feed jam has occurred in the stacking status which is not of Level 1), the processing proceeds to Step #17 without changing the level of the stacking status.

As described above, according to the present invention, for example, in the case where a non-feed jam occurs, the user may once remove the sheets and then place again the sheets without reducing the number thereof. In such a case, when the sheet feeding operation is performed after that, a non-feed jam is highly likely to occur again. In view of this, when the rotary body (original document feeding roller 12) is detected to be in the upper limit position by the upper limit detection portion (upper limit detection sensor 83) when the sheet stack that has caused the non-feed jam is once removed from the sheet placing table (the original document tray 11 and the raising and lowering part 17) and the sheet stack (original document stack) is placed again on the sheet placing table, the control part (original document transport control part 9) determines that the sheet feeder is brought into the sheet feeding restriction state and does not rotate the rotary body (original document feeding roller 12). In this manner, the sheet feeding operation is not performed when a non-feed jam is highly likely to occur. Accordingly, the occurrence of a non-feed jam may be prevented.

Further, the sheet feeder is brought into the sheet feeding restriction state only after a non-feed jam has occurred at least once. In other words, even when the rotary body (original document feeding roller 12) is detected to be in the upper limit position by the upper limit detection portion (upper limit detection sensor 83), the sheet feeding operation is performed at least once. In this manner, even when the rotary body is detected to be in the upper limit position by the upper limit detection portion when sheets are placed, the sheet feeding operation may be performed without any problem when the sheets are placed to a thickness that falls within a range that does not cause a non-feed jam. Accordingly, the thickness of the sheet stack to be placed at one time may be prevented from being reduced from a thickness of a sheet stack that may originally be loadable on the device.

Further, the control part (original document transport control part 9) performs the sheet feeding operation when the upper limit detection portion (upper limit detection sensor 83) does not detect the upper limit with sheets being set under a state in which the memory portion stores the sheet feeding restriction state. For example, when the number of sheets to be set is reduced, that is, when the sheet stack set again is identified to be in a thickness that does not cause a non-feed jam even when the sheet feeding restriction state is stored, sheet feeding operation is performed. Further, when the sheet feeding operation is completed without causing a non-feed jam, the data indicating the sheet feeding restriction state stored in the memory portion (memory 92) is deleted. In this manner, the sheet feeding restriction state does not last for a long period.

Further, the user may sometimes set sheets more than once that has caused a non-feed jam without giving it up, without reducing the number thereof even after a non-feed jam has occurred. However, when sheets are set, the control part (original document transport control part 9) does not rotate the rotary body, under a state in which the sheet feeding restriction state is stored and the rotary body (the original document feeding roller 12) is detected to be in the upper limit position by the upper limit detection portion (upper limit detection sensor 83). In this manner, even when the sheet stack that has caused a non-feed jam is repeatedly set by the user without being reduced in number, the sheet feeding operation is not performed. Accordingly, the sheet feeding operation may be prevented from being performed in a state in which a non-feed jam is highly likely to occur, to thereby reduce the frequency of occurrence of a non-feed jam.

Further, in a state in which the sheet feeding restriction state is not stored, when sheets are set, the control part (original document transport control part 9) rotates the rotary body (original document feeding roller 12) regardless of the detection state of the upper limit detection portion (upper limit detection sensor 83). In this manner, the sheet feeding operation is tried at least once on the sheets set by the user, and when the sheets thus placed has a thickness falling within a range that does not cause a non-feed jam, the sheet feeding operation is performed without any problem. Accordingly, the thickness of the sheet stack to be placed at one time may be prevented from being reduced as compared with the thickness of a sheet stack or an original document stack that may originally be loadable in the device. Further, the notifying part (operation panel 2) notifies that the set original documents are too many. In response to this, the user can recognize that the number of sheets in the sheet stack (original document stack) to be placed on the sheet placing table (original document tray 11) needs to be reduced. Accordingly, the occurrence of a non-feed jam may be prevented.

Further, in the sheet feeder 1, the sheet placing table (original document tray 11) may be raised or lowered, in order to bring the rotary body (original document feeding roller 12) into contact with the uppermost sheet. When the upper limit detection portion (upper limit detection sensor 83) detects that the rotary body is in the upper limit position before the raising and lowering part 17 raises the sheet placing table, the control part (original document transport control part 9) imposes the sheet feeding restriction. In this manner, the sheet feeding operation may not be performed when a non-feed jam is highly likely to occur. Further, the original document transport device 100 and the image forming apparatus may be provided, in which the number of occurrences of a non-feed jam is reduced to at most one per one sheet stack. Further, the thickness of the sheet stack (original document stack) to be stacked at one time may not be reduced as compared with the thickness of the sheet stack or the original document stack which may originally be loadable in the device.

(Sheet Feeding Part 4)

Next, with reference to FIGS. 1 and 4, the sheet feeding part 4 of the present invention is described. In the above-mentioned embodiment, the sheet feeder 1 in the original document transport device 100 is described by way of example. However, the present invention may be applied to deal with a non-feed jam that may be caused by overstacking in the sheet feeding part 4 including cassettes or the like in the multifunction peripheral 200 main body.

As illustrated in FIG. 1, each cassette includes a placing plate 43 (corresponding to the sheet placing table) and a sheet feeding roller 42 (corresponding to the rotary body) which comes into contact with the uppermost sheet of the stacked sheets. Note that, each sheet feeding roller 42 may be movable in a vertical direction. Alternatively, for example, in order to detect whether any sheet is placed on the placing plate 43, a sheet placement sensor 44 (corresponding to the sheet placement detection portion), which employs a reflective or transmissive optical sensor, may be disposed below the placing plate 43.

Further, as illustrated in FIG. 1 or FIG. 4, each sheet feeding roller 42 is provided with an upper limit sensor 45 (corresponding to the upper limit detection portion) for detecting that the sheet feeding roller 42 has reached the upper limit position. Alternatively, for example, in order to detect the transport of a sheet such as the arrival or passage of a sheet, a transport detection sensor 46 (corresponding to the transport detection portion) including an optical sensor may be provided between the cassette and the transport path 5 or between the cassette and the image forming part 6.

Each cassette 41 includes the placing plate 43 for receiving sheets to be placed thereon. Each placing plate 43 has an end portion on the upstream side in the sheet transport direction serving as a pivot point and another end portion on the downstream side in the sheet transport direction serving as a free end, and the free end moves in a vertical direction.

A shaft 47, a push-up member 48, a push-up motor M40 (see FIG. 4), and the like are provided to each cassette 41 for raising the placing plate 43. The shaft 47 is disposed below each placing plate 43, and extends in a direction perpendicular to the sheet transport direction. Then, the push-up member 48 is attached to the shaft 47. The push-up member 48 is in a plate-like shape and contacts with a lower surface of the placing plate 43. The push-up motor M40 rotates the shaft 47 to change the angle formed by the push-up member 48, to thereby raise the placing plate 43. The sheet feeding roller 42 is swingable (movable) in a vertical direction to some extent.

For example, when the cassette 41 is detached from the multifunction peripheral 200, the push-up member 48 is prostrated. On the other hand, when the cassette 41 is set to the multifunction peripheral 200, the push-up motor M40 rotates, so that the placing plate 43 is pushed up. Further, above the sheet feeding roller 42, there is provided an upper limit sensor 45 for detecting that the sheet feeding roller 42 has reached the upper limit position. The push-up motor M40 continues to rotate until the upper limit sensor 45 detects that the sheet feeding roller 42 has reached the upper limit, to thereby pushes up the placing plate 43. The upper limit sensor 45 includes, for example, an optical sensor, which is changed in output when the sheet feeding roller 42 is held up to a certain extent. Meanwhile, when sheets are used for printing to be reduced in number and the upper limit sensor 45 no longer detects that the upper limit is reached by the sheet feeding roller 42, the push-up motor M40 rotates, to thereby push up the placing plate 43. As a result, the sheet feeding roller 42 is always in contact with the uppermost sheet. Note that, FIG. 1 illustrates a state in which the placing plate 43 is raised to the upper limit position for bringing the uppermost sheet and the sheet feeding roller 42 into contact with each other.

The main body control part 201 controls the rotations of the sheet feeding motor M41 and the push-up motor M40. Further, the main body control part 201 detects the occurrence of a non-feed jam, based on the outputs from the sheet placement sensor 44, the upper limit sensor 45, the transport detection sensor 46, and the like. For example, when the transport detection sensor 46 detects no sheet arriving even when sheet feeding operation is performed under a state in which, for example, the sheet placement sensor 44 has detected the presence of sheets and the upper limit sensor 45 has detected that the sheet feeding roller 42 has reached the upper limit, the main body control part 201 determines that a non-feed jam has occurred. At the occurrence of a non-feed jam, the main body control part 201 may perform display on the operation panel 2 for notifying that a sheet stacking amount in the cassette is too large. Alternatively, the main body control part 201 may use the storage device 203 to perform the sheet feeding restriction control at the occurrence of a non-feed jam, similarly to the case of the original document transport device 100.

Next, another embodiment is described. In the above-mentioned embodiments of the present invention, a description has been given of an exemplary case where the original document transport control part 9 is disposed inside the original document transport device 100, and the original document transport control part 9 determines whether the stacking state is the sheet feeding restriction state (Level 2), and controls the rotation of the original document feeding roller 12, to thereby perform sheet transport control. Alternatively, the original document transport device 100 may be controlled by the main body control part 201, without providing the original document transport control part 9. In this case, the control part of the multifunction peripheral 200 also serves as the control part of the sheet feeder 1 and the original document transport device 100. The output from each sensor in the original document transport device 100 is input to the main body control part 201.

As described above, the present invention is applicable to a sheet feeder, and to an original document transport device and an image forming apparatus including the sheet feeder.

Further, as illustrated in the flow charts of FIGS. 6 and 7, the present invention also relates to a sheet feeding method for use in a sheet feeder. Specifically, a sheet feeding method according to the present invention at least includes: detecting that sheets are set on a sheet placing table for receiving sheets to be set thereon; detecting, by an upper limit detection portion, that a rotary body movable in a vertical direction, which comes into contact with an uppermost sheet of the set sheets and rotates to send out the sheets from the sheet placing table, is in an upper limit position; feeding the sheets through rotation of the rotary body, regardless of a detection state of the upper limit detection portion when the sheets are set on the sheet placing table; determining that a non-feed jam has occurred when a transport detection portion disposed on a downstream side in a sheet transport direction with respect to the sheet placing table detects no sheet arriving; and stopping the rotation of the rotary body, by determining that the sheet feeder is brought into a sheet feeding restriction state in which sheet feeding restriction should be imposed, when sheets are placed again on the sheet placing table and the upper limit detection portion detects that the rotary body is in the upper limit position.

While the present invention has been described with reference to exemplary embodiments, it is to be understood that the scope of the present invention is not limited to the disclosed exemplary embodiments, and various modifications may be made thereto without departing from the gist of the invention.

What is claimed is:

1. A sheet feeder, comprising:

a sheet placing table for receiving sheets thereon;

a rotary body which is movable in a vertical direction, which comes into contact with an uppermost sheet on the sheet placing table, and which rotates to send out sheets from the sheet placing table;

a sheet placement detection portion for detecting placement of sheets on the sheet placing table;

an upper limit detection portion for detecting that the rotary body is in an upper limit position;

a transport detection portion for detecting transport of sheets, the transport detection portion being disposed on a downstream side in a sheet transport direction with respect to the sheet placing table;

a memory portion for storing data indicating whether the sheet feeder is in a sheet feeding restriction state in which sheet feeding restriction should be imposed; and a control part which rotates the rotary body so as to perform a sheet feeding operation regardless of a detection state of the upper limit detection portion when sheets are first set on the sheet placing table, wherein when the control part determines that a non-feed jam has occurred when the transport detection portion detects no sheet arriving, the control part stops rotating the rotary body by determining that the sheet feeder is brought into the sheet feeding restriction state when sheets are again set on the sheet placing table and the upper limit detection portion detects that the rotary body is in the upper limit position, and wherein, when sheets are again set on the sheet placing table, the control part rotates the rotary body when the upper limit detection portion detects that the rotary body is not in the upper limit position even when the memory portion stores data indicating that the sheet feeder is in the sheet feeding restriction state, and deletes the data indicating that the sheet feeder is in the sheet feeding restriction state from the memory portion when the sheet feeding operation is completed without causing a non-feed jam.

2. A sheet feeder according to claim 1, wherein, when sheets are set on the sheet placing table, the control part stops rotating the rotary body when the memory portion stores data indicating that the sheet feeder is in the sheet feeding restriction state, under a state in which the upper limit detection portion detects that the rotary body is in the upper limit position.

3. A sheet feeder according to claim 1, wherein, when the memory portion does not store data indicating that the sheet feeder is in the sheet feeding restriction state, the control part rotates the rotary body when sheets are set on the sheet placing table, regardless of the detection state of the upper limit detection portion.

4. A sheet feeder according to claim 1, further comprising a notifying part for notifying a state of the sheet feeder, wherein the notifying part notifies that too many sheets are set, when the feeder is brought into the sheet feeding restriction state, and when the sheets are set on the sheet placing table and the upper limit detection portion detects that the rotary body is in the upper limit position under a state in which the memory portion stores data indicating that the sheet feeder is in the feeding restriction state.

5. A sheet feeder according to claim 4, wherein the notifying part displays a message image for instructing to reduce a number of sheets, and wherein the notifying part clears the displayed message image when the upper limit detection portion detects that the rotary body is not in the upper limit position after sheets are set again.

6. A sheet feeder according to claim 1, wherein the sheet feeder comprises a sheet feeding part for receiving and feeding sheets for use in image formation.

7. An original document transport device comprising the sheet feeder according to claim 1.

8. An image forming apparatus comprising the sheet feeder according to claim 1.

9. A sheet feeder comprising:

a sheet placing table for receiving sheets thereon;

a rotary body which is movable in a vertical direction, which comes into contact with an uppermost sheet on the sheet placing table, and which rotates to send out sheets from the sheet placing table;

a sheet placement detection portion for detecting placement of sheets on the sheet placing table;

an upper limit detection portion for detecting that the rotary body is in an upper limit position;

a transport detection portion for detecting transport of sheets, the transport detection portion being disposed on a downstream side in a sheet transport direction with respect to the sheet placing table;

a memory portion for storing data indicating whether the sheet feeder is in a sheet feeding restriction state in which sheet feeding restriction should be imposed; and a control part which rotates the rotary body so as to perform a sheet feeding operation regardless of a detection state of the upper limit detection portion when sheets are first set on the sheet placing table, wherein when the control part determines that a non-feed jam has occurred when the transport detection portion detects no sheet arriving, the control part stops rotating the rotary body by determining that the sheet feeder is brought into the sheet feeding restriction state when sheets are again set on the sheet placing table and the upper limit detection portion detects that the rotary body is in the upper limit position, and wherein the sheet feeder further comprises a raising and lowering part for raising and lowering the sheet placing table, wherein the raising and lowering part lowers the sheet placing table to a lower limit position when no sheet is set on the sheet placing table, and raises, when sheets are set on the sheet placing table, the sheet placing table until the upper limit detection portion detects that the rotary body has reached the upper limit position, and wherein, when sheets that have caused a non-feed jam are removed from the sheet placing table and then sheets are newly set on the sheet placing table, the control part determines that the sheet feeder is brought into the sheet feeding restriction state, when the upper limit detection portion has detected that the rotary body is in the upper limit position before the raising and lowering part raises the sheet placing table.

10. A sheet feeding method for a sheet feeder, the method comprising:

detecting that sheets are set on a sheet placing table for receiving sheets to be set thereon;

detecting, by an upper limit detection portion, that a rotary body, which is movable in a vertical direction, which comes into contact with an uppermost sheet on the sheet placing table, and which rotates to send out sheets from the sheet placing table, is in an upper limit position;

feeding the sheets through rotation of the rotary body, regardless of a detection state of the upper limit detection portion when sheets are first set on the sheet placing table;

determining that a non-feed jam has occurred when a transport detection portion disposed on a downstream side in a sheet transport direction with respect to the sheet placing table detects no sheet arriving; and stopping the rotation of the rotary body, by determining that the sheet feeder is brought into a sheet feeding restriction state in which sheet feeding restriction should be imposed, when sheets are placed again on the sheet placing table and the upper limit detection portion detects that the rotary body is in the upper limit position, wherein the method further comprises:

storing, by a memory portion, data indicating that the sheet feeder is in the sheet feeding restriction state;

rotating, when sheets are again set on the sheet placing table, the rotary body when the upper limit detection portion detects that the rotary body is not in the upper limit position even when the memory portion stores data indicating that the sheet feeder is in the sheet feeding restriction state; and deleting form the memory portion, stored data indicating that the sheet feeder is in the sheet feeding restriction state when a sheet feeding operation is completed without causing a non-feed jam.

11. A sheet feeding method according to claim 10, further comprising stopping, when sheets are set on the sheet placing table, rotating the rotary body when the memory portion stores data indicating that the sheet feeder is in the sheet feeding restriction state, under a state in which the upper limit detection portion detects that the rotary body is in the upper limit position.

12. A sheet feeding method according to claim 10, further comprising rotating, when the memory portion does not store data indicating that the sheet feeder is in the sheet feeding restriction state, the rotary body when sheets are set on the sheet placing table, regardless of the detection state of the upper limit detection portion.

13. A sheet feeding method according to claim 10, further comprising notifying, by a notifying part for notifying a state of the sheet feeder, that too many sheets are set, when the sheet feeder is brought into the sheet feeding restriction state, and when the sheets are set on the sheet placing table and the upper limit detection portion detects that the rotary body is in the upper limit position under a state in which the memory portion stores data indicating that the sheet feeder is in the sheet feeding restriction state.

14. A sheet feeding method according to claim 13, further comprising:

displaying, by the notifying part, a message image for instructing to reduce a number of sheets; and clearing, by the notifying part, the displayed message image when the upper limit detection portion detects that the rotary body is not in the upper limit position after sheets are set again.

15. A sheet feeding method according to claim 10, further comprising:

lowering, by a raising and lowering part for raising and lowering the sheet placing table, the sheet placing table to a lower limit position when no sheet is set on the sheet placing table;

raising, by the raising and lowering part, when sheets are set on the sheet placing table, the sheet placing table until the upper limit detection portion detects that the rotary body has reached the upper limit position; and determining, by a control part, when sheets that have caused a non-feed jam are removed from the sheet placing table and then sheets are newly set on the sheet placing table, that the sheet feeder is brought into the sheet feeding restriction state, when the upper limit detection portion has detected that the rotary body is in the upper limit position before the raising and lowering part raises the sheet placing table.

* * * * *